US010858871B2

(12) United States Patent
Kawulka et al.

(10) Patent No.: US 10,858,871 B2
(45) Date of Patent: Dec. 8, 2020

(54) PANEL DOOR SYSTEM

(71) Applicant: GOOD GATE INC., Edmonton (CA)

(72) Inventors: Graham Ivan Kawulka, Edmonton (CA); Calvin Aaron Austrom, Edmonton (CA)

(73) Assignee: GOOD GATE INC., Edmonton (CA)

( * ) Notice: Subject to any disclaimer, the term of this patent is extended or adjusted under 35 U.S.C. 154(b) by 204 days.

(21) Appl. No.: 16/117,268

(22) Filed: Aug. 30, 2018

(65) Prior Publication Data

US 2019/0169898 A1 Jun. 6, 2019

Related U.S. Application Data

(60) Provisional application No. 62/594,598, filed on Dec. 5, 2017.

(51) Int. Cl.

| | |
|---|---|
| ***E05D 15/08*** | (2006.01) |
| ***E06B 3/46*** | (2006.01) |
| ***E05D 15/06*** | (2006.01) |

(52) U.S. Cl.

CPC ..... *E05D 15/08* (2013.01); *E05D 15/0652* (2013.01); *E06B 3/4636* (2013.01); *E05Y 2900/132* (2013.01)

(58) Field of Classification Search

CPC ..... E05Y 2800/122; E05Y 2900/142; E05D 15/08; E05D 15/0652; E04B 2/827; E06B 3/4636

See application file for complete search history.

(56) References Cited

U.S. PATENT DOCUMENTS

| | | | | | |
|---|---|---|---|---|---|
| 1,960,860 | A | | 5/1934 | Allen | |
| 2,025,566 | A | | 12/1935 | Bogart | |
| 2,218,068 | A | | 10/1940 | Klein | |
| 2,280,368 | A | * | 4/1942 | Bassett | B64C 1/1476 244/121 |
| 2,944,282 | A | * | 7/1960 | Greco | E04B 2/827 16/87 R |
| 3,642,051 | A | * | 2/1972 | Goldner | E06B 3/922 160/197 |
| 4,073,034 | A | | 2/1978 | Martens | |
| 4,616,451 | A | * | 10/1986 | Glick | E04B 7/166 49/125 |
| 4,635,699 | A | * | 1/1987 | Kauffman | B23Q 11/0825 160/211 |
| 4,752,106 | A | * | 6/1988 | Salvarani | E06B 3/4672 312/295 |
| 4,987,638 | A | | 1/1991 | Ribaudo | |

(Continued)

*Primary Examiner* — Justin B Rephann

(74) *Attorney, Agent, or Firm* — Davis & Bujold PLLC; Michael J. Bujold

(57) ABSTRACT

A panel door system has at least two support tracks and at least two panels hanging from the at least two support tracks. The at least two support tracks are mounted to a support structure such that each support track is offset from a previous support track both horizontally and vertically. The least two panels are hung using hanging mechanism such that each panel is hung on a different support track. The at least two panels create a door. The at least two panels are movable along the at least two support tracks in a first direction to open the door and in a second direction to close the door. The at least two panels stack horizontally with each other when the door is in the open position.

8 Claims, 7 Drawing Sheets

(56) References Cited

U.S. PATENT DOCUMENTS 5,109,911 A 5/1992 Bockisch
5,121,817 A 6/1992 Garrido et al.
5,156,195 A * 10/1992 Wehler ..... E04B 1/34305 160/202
5,551,501 A * 9/1996 Davis ..... E06B 9/52 160/87
5,832,980 A * 11/1998 Cianciolo ..... E05D 15/58 160/197
5,839,543 A 11/1998 Chiu
5,863,163 A * 1/1999 Wehler ..... B23Q 11/0825 160/202
6,082,499 A 7/2000 O'Donnell
6,497,265 B2 * 12/2002 Davis ..... E06B 9/52 160/87
7,174,944 B1 * 2/2007 Clark ..... E05D 15/063 16/96 R
7,346,939 B2 * 3/2008 Perry ..... A47K 3/34 4/557
7,424,935 B1 9/2008 Smith
7,451,802 B2 * 11/2008 Cianciolo ..... E05D 15/08 160/210
7,730,929 B2 * 6/2010 Perron ..... E05F 17/004 160/202
8,297,334 B2 * 10/2012 Chu ..... E06B 9/36 160/222
8,973,643 B2 3/2015 Molteni
9,212,027 B1 12/2015 Chase et al.
9,376,849 B2 * 6/2016 Lim ..... E06B 3/481
2004/0049984 A1 * 3/2004 Pfaff ..... E05F 17/00 49/116
2007/0107309 A1 * 5/2007 Molteni ..... E05F 17/004 49/125
2007/0119548 A1 * 5/2007 Anderson ..... E05D 15/58 160/211
2007/0169899 A1 * 7/2007 Cianciolo ..... E05D 15/08 160/211
2008/0105388 A1 * 5/2008 Huang ..... A47H 23/04 160/202
2011/0240234 A1 10/2011 Jans

* cited by examiner

PANEL DOOR SYSTEM

FIELD OF THE DISCLOSURE

The present application relates generally to a panel door system, more particularly it relates to a side opening panel door system.

BACKGROUND

This section provides background information to facilitate a better understanding of the various aspects of the invention. It should be understood that the statements in this section of this document are to be read in this light, and not as admissions of prior art.

Panel doors have been used in a number of installations to provide controlled access to an entrance. In many such installations, access to the entrance is controlled by sliding the door into and out of the entrance. In general, there are two basic types of panel doors that operate in this manner: center opening and side opening.

Conventional center opening doors include a pair of co-planar panels capable of being slid away from one another to open the door and expose the entrance. When in the fully open position, the panels are located on opposite sides of the entrance. The door can be closed by sliding the panels towards each other until their leading edges abut one another. Because the panels are coplanar, they may be supported by a single track to simplify mounting. These center opening doors suffer from the disadvantage that a door-receiving space is required on both sides of the entrance to receive the panels when the door is open. Furthermore, the combined width of the door receiving space must be not less than the width of the entrance.

Panel doors with side openings overcome this problem by utilizing at least two panels supported for travel in substantially parallel planes. Unlike the panels of center opening doors, the panels of side opening doors travel in the same direction to open the door and expose the entrance and in the opposite direction to close the door and obstruct the entrance. When the door is closed, the panels are horizontally staggered across the entrance. In the open position, the panels are located on one side of the entrance and are aligned one behind the other in the door receiving space. Thus, the width of the door receiving space can be less than the width of the entrance. For a two panel, side opened door, the space required may be reduced to approximately one half the width of the entrance. By employing a side opening door with more than two panels, the width of the door receiving space can be reduced further.

A disadvantage of side opening panel door systems is that, although the door receiving space is reduced in width, the depth of the door receiving space must be increased to accommodate the multiple panels.

A further problem with panel door systems can be the large distance between the wall/entrance plane and the surface of the panel furthest from the entrance plane. This is a direct result of the panel thickness which is driven by the need to resist deflection or deformation from lateral loads placed on the panel by users, either intentionally or accidentally. The larger the height of the panel/entrance, the more substantial this problem becomes due to obvious mechanical engineering reasons understood by persons skilled in the art.

BRIEF SUMMARY

There is provided a panel door system that has at least two support tracks and at least two panels hanging from the at least two support tracks. The at least two support tracks are mounted to a support structure such that each support track is offset from a previous support track both horizontally and vertically. The at least two panels are hung from the at least two support tracks using hanging mechanisms such that each panel is mounted on a different support track. The at least two panels create a door. The at least two panels are movable along the at least two support tracks in a first direction to open the door and in a second direction to close the door. The at least two panels stack horizontally with each other when the door is in the open position.

In one embodiment, the at least two support tracks are mounted such that each adjacent track is positioned anterior to and above the previous track with the first track being the lowest and most posterior track.

In one embodiment, the horizontal offset and the vertical offset are equal. This creates the visual effect of an upside down staircase and allows for the at least two panels to be stacked more closely together when the door is in the open position.

In one embodiment, the hanging mechanism is at least one roller.

In one embodiment, a bottom end of the at least two panels is positioned within a bottom guide groove. The bottom guide groove provides guidance to the at least two panels and prevents excessive swinging of the at least two panels during movement.

In one embodiment, the support structure is a header. The at least two support tracks may be attached along their entire length to the header by any type of fastener known to a person skilled in the art and may include, but is not limited to, nails, screws, glue, rivets and/or staples. The at least two support tracks may be attached directly to the header or may be attached to the header using brackets or any other method known to a person skilled in the art.

In another embodiment, the support structure supports the ends of the at least two tracks. In this embodiment, the at least two support tracks may span an open space between two structures such as beams. The at least two support tracks may be attached directly to the support structure or may be attached to the support structure using brackets or any other method known to a person skilled in the art.

In one embodiment, the at least two panels are made of extruded aluminum.

In one embodiment, the at least two panels stack horizontally within a door receiving space when the door is in the open position. This provides complete access to an entrance as the at least two panels are hidden within the door receiving space.

In one embodiment, the hanging mechanism includes an orthogonal element protruding from the at least two support tracks. The horizontal offset is sized such that adjacent panels may be stacked horizontally in close proximity to each other despite the orthogonal element.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
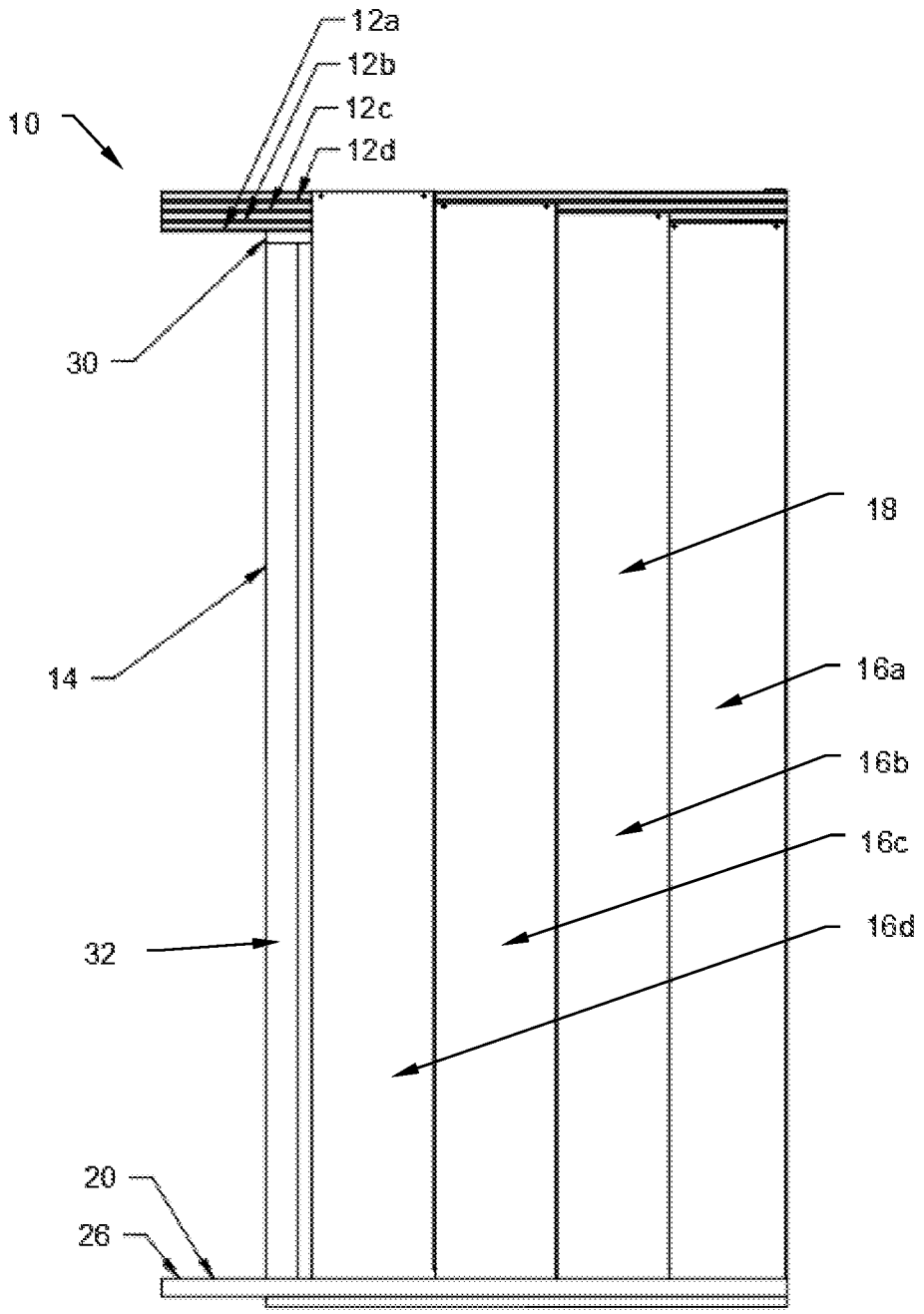
FIG. 1 is a front elevation view of a panel door system in the closed position.
Figure 2:
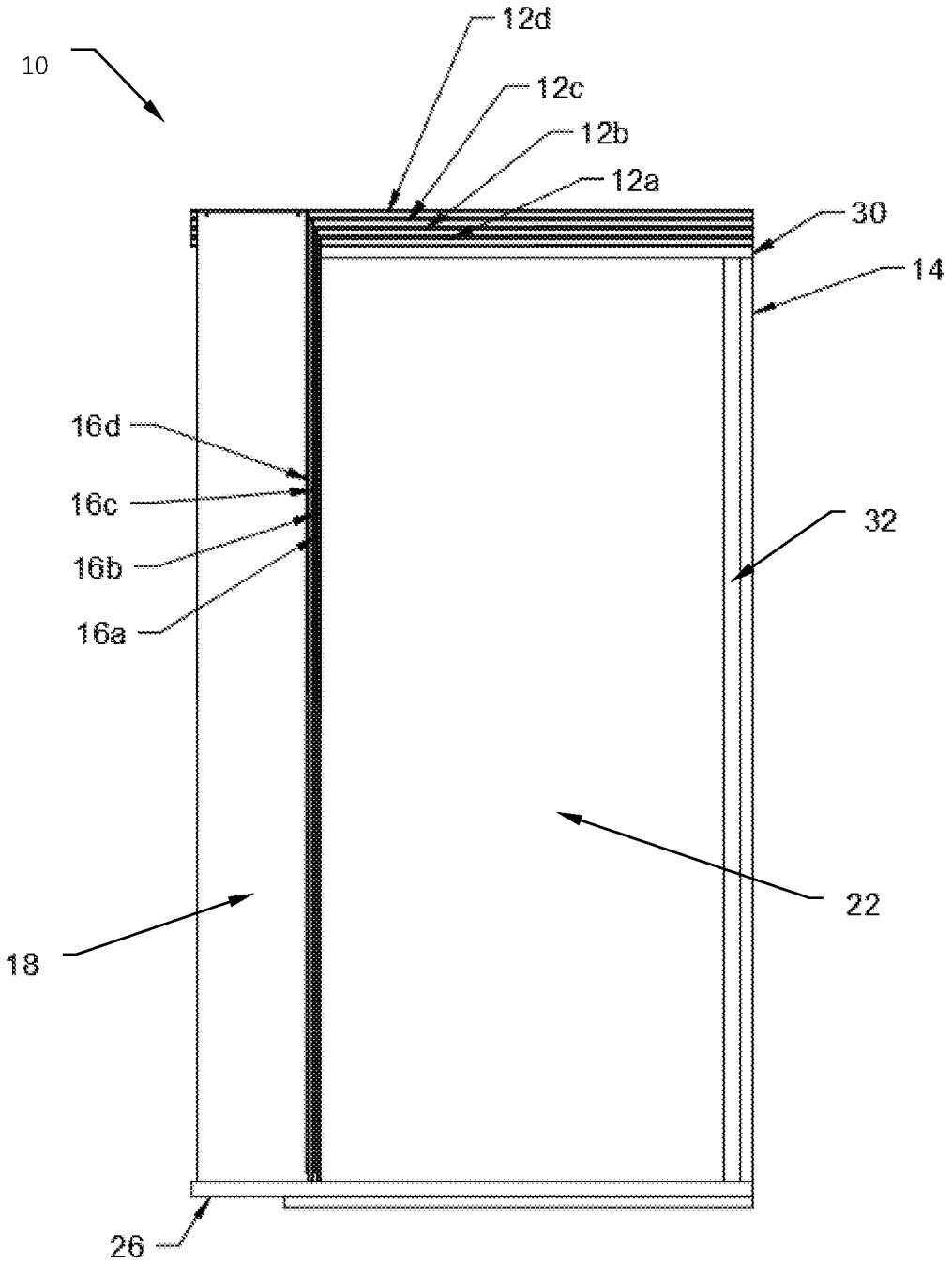
FIG. 2 is a front elevation view of the panel door system in the open position shown in FIG. 1.

A panel door system, generally identified by reference numeral 10, will now be described with reference to FIG. 1 through FIG. 7.

Figure 5:
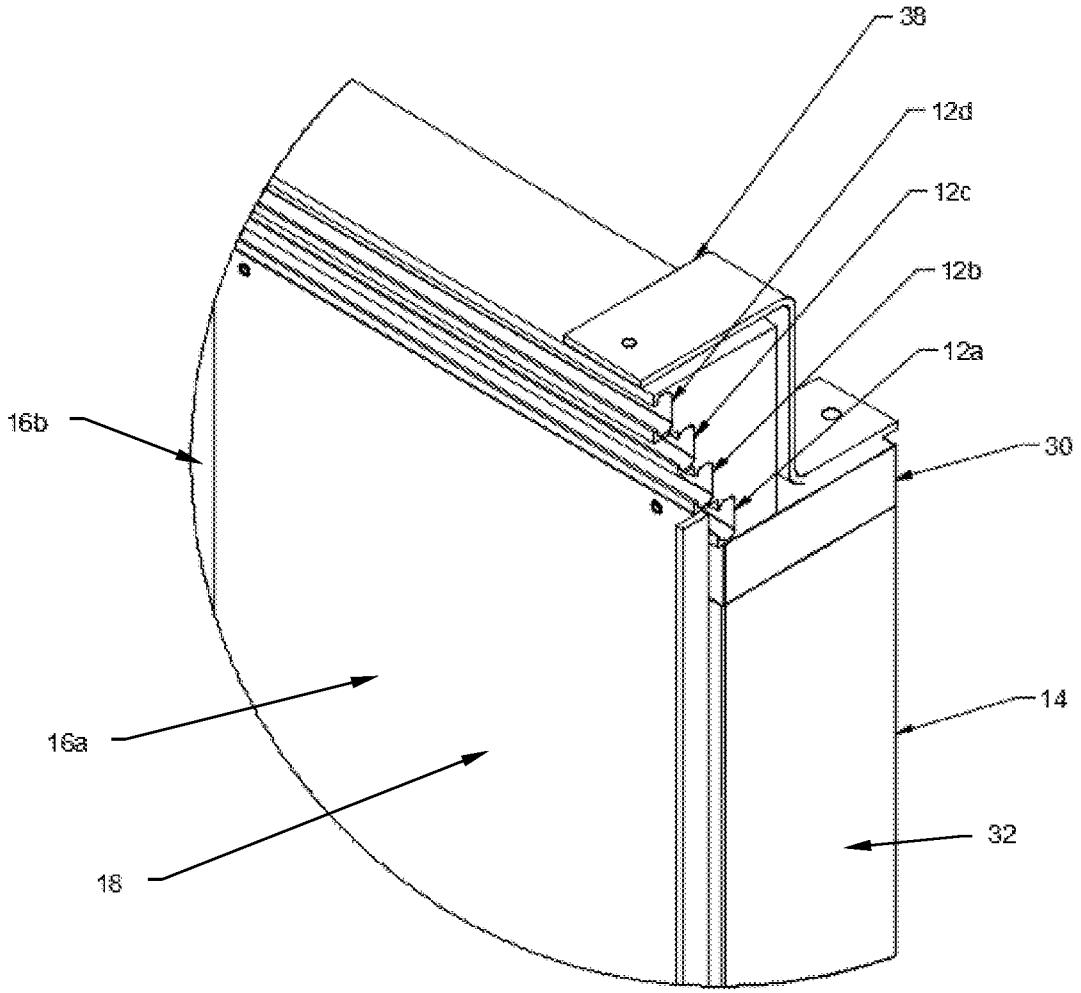
FIG. 5 is a detailed perspective view of the support tracks of the panel door system shown in FIG. 1.
Figure 6:
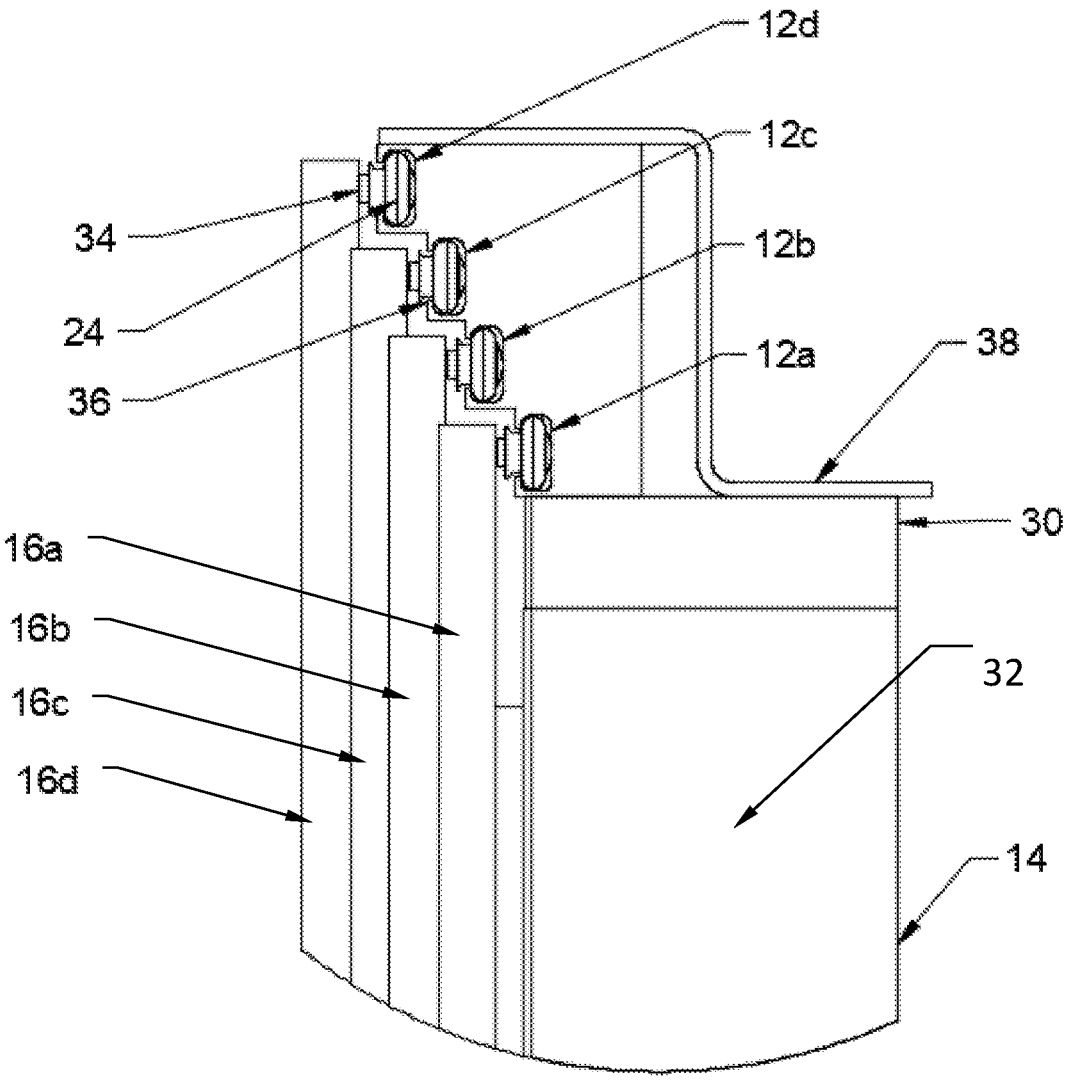
FIG. 6 is a side elevation view of the support tracks of the panel door system shown in FIG. 1.

Referring to FIG. 1, panel door system 10 has support tracks 12*a*, 12*b*, 12*c* and 12*d* mounted to a support structure 14 and panels 16*a*, 16*b*, 16*c* and 16*d*. It will be understood by a person skilled in the art that any number of support tracks and panels may be used as long as there are two or more and the number of support tracks should be equal to the number of panels. As an example, where two support tracks are used, two corresponding panels should be present. In the embodiment shown, four support tracks 12*a*, 12*b*, 12*c* and 12*d* and four panels are used 16*a*, 16*b*, 16*c* and 16*d*. Referring to FIG. 6, as can be seen, support track 12*b* is offset from support track 12*a* both horizontally and vertically, support track 12*c* is offset from support tracks 12*a* and 12*b* both horizontally and vertically and support track 12*d* is offset from support tracks 12*a*, 12*b* and 12*c* both horizontally and vertically. Support track 12*a* is the lowest and most posterior track mounted to support structure 14 with support track 12*b* being positioned anterior to and above support track 12*a*, support track 12*c* being positioned anterior to and above support track 12*b* and support track 12*d* being positioned anterior to and above support track 12*c*. It will be understood that each adjacent track is positioned anterior to and above the previous track when mounted to support structure 14. Referring to FIG. 5, this creates a staggering configuration in both the horizontal and vertical planes. The horizontal and vertical offsets between support tracks may be equal. All support tracks could be made in one complete piece or as a set of individual tracks that are then secured to each other in some suitable manner to resist loads and deflection.

The horizontal and vertical offsets between support tracks 12*a*, 12*b*, 12*c* and 12*d* allow for the use of multiple panels while reducing the width of door receiving space 20 and the required depth of door receiving space 20. The offsets of tracks 12*a*, 12*b*, 12*c* and 12*d* allow panels 16*a*, 16*b*, 16*c* and 16*d* to stack horizontally more closely together.

In the embodiment shown in FIG. 1-FIG. 6, support structure is a header 30. Header 30 provides for support of support tracks 12*a*, 12*b*, 12*c* and 12*d*. Referring to FIG. 6, header 30 may have a flat outer surface which may require the use of brackets 38 to attach and space support tracks 12*a*, 12*b*, 12*c* and 12*d* properly. Support tracks 12*a*, 12*b*, 12*c* and 12*d* may be integrally formed with header 30. Support columns 32 may also be used in conjunction with header 30.

Figure 7:
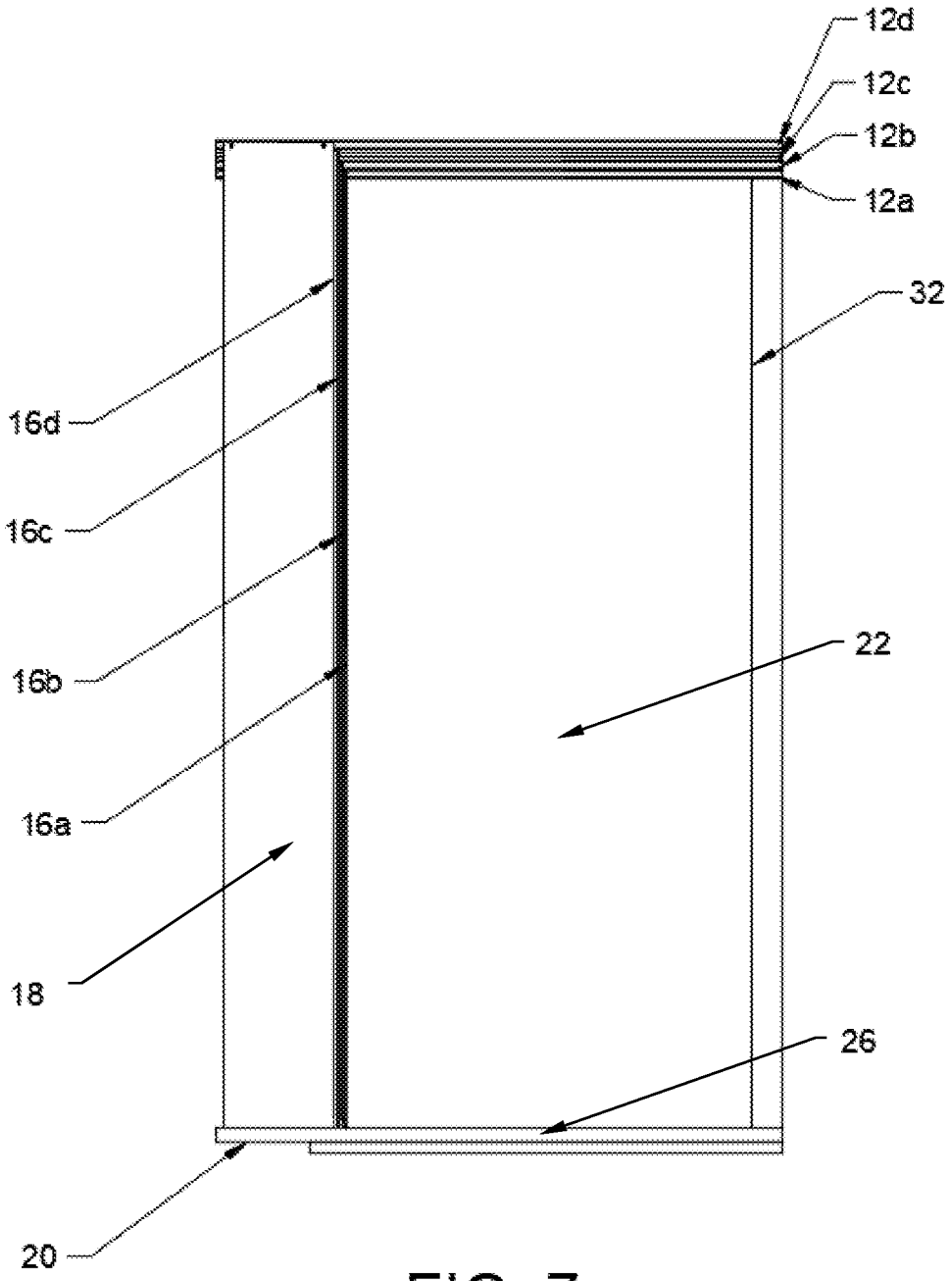
FIG. 7 is a front elevation view of the panel door system with a variation of the support structure for the support tracks.

In the embodiment shown in FIG. 7, support structure is a pair of support columns 32 on either side of entrance 22. Support tracks 12*a*, 12*b*, 12*c* and 12*d* span entrance 22 between support columns 32. Support tracks 12*a*, 12*b*, 12*c* and 12*d* may be attached directly to support columns 32 or may be attached to support columns 32 using brackets or any other method known to a person skilled in the art. Support columns 32 may be notched out to create the appropriate spacing between support tracks or appropriate spacing may be created through mounting support tracks using brackets of appropriate sizes.

Figure 3:
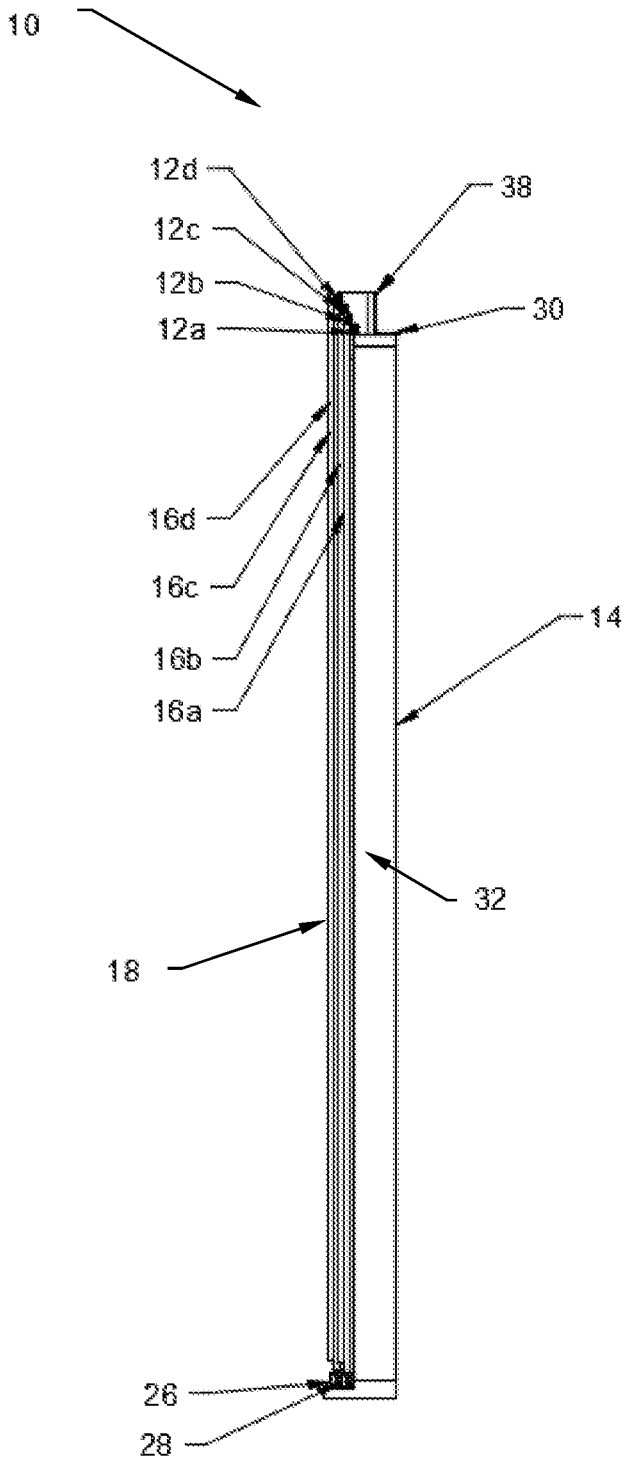
FIG. 3 is a side elevation view of the panel door system in the closed position shown in FIG. 1.

Referring to FIG. 1 and FIG. 3, panels 16*a*, 16*b*, 16*c* and 16*d* hang from support tracks 12*a*, 12*b*, 12*c* and 12*d*, respectively, such that each panel is mounted on a different support track. Panels 16*a*, 16*b*, 16*c* and 16*d* create a door 18 with panels 16*a*, 16*b*, 16*c* and 16*d* being movable along support tracks 12*a*, 12*b*, 12*c* and 12*d* in a first direction to open door 18, shown in FIG. 2 and FIG. 4, and in a second direction to close door 18, shown in FIG. 1 and FIG. 3. Each panel 16*a*, 16*b*, 16*c* and 16*d* travel a different distance during opening and closing of the door. Panel 16*a* travels the shortest distance as it is closest to door receiving space 20, while panel 16*d* travels the greatest distance as it is the farthest from door receiving space 20. Panels 16*a*, 16*b*, 16*c* and 16*d* stack horizontally with each other when door 18 is in the open position. In the embodiments shown, when door 18 is in the open position, panels 16*a*, 16*b*, 16*c* and 16*d* stack within a door receiving space 20 positioned to one side of an entrance 22. Door receiving space 20 allows for an unobstructed entrance 22 as panels 16*a*, 16*b*, 16*c* and 16*d* appear hidden within door receiving space 20. The width of door receiving space 20 may dictate the width of panels 16*a*, 16*b*, 16*c* and 16*d* and the number of panels used to cover entrance 22. Where a narrower door receiving space 20 is provided, a larger number of more narrow panels may be used to accommodate the size of door receiving space 20. A larger number of more narrow panels will require a deeper door receiving space 20 than a smaller number of wider panels.

In the embodiment shown, hanging mechanism utilizes rollers 24. In the embodiment shown, two rollers 24 are used, however it will be understood by a person skilled in the art that a single roller 24 or multiple rollers 24 may be used and the number of rollers 24 is limited only by the space available. Hanging mechanism may also include an orthogonal element 34 protruding from support tracks 12*a*, 12*b*, 12*c* and 12*d*. As can be seen, orthogonal elements 34 are connected to rollers 24 and panels 16*a*, 16*b*, 16*c* and 16*d* and act as an intermediary between rollers 24 and panels. Support tracks 12*a*, 12*b*, 12*c* and 12*d* may have edges 36 to fully capture or guide rollers 24 or other mechanisms of hanging panels 16*a*, 16*b*, 16*c* and 16*d*. It will be understood by a person skilled in the art that other methods of hanging panels may be used between support tracks and panels, including but not limited to tongue and groove connections, ball bearings and any other method known in the art.

Figure 4:
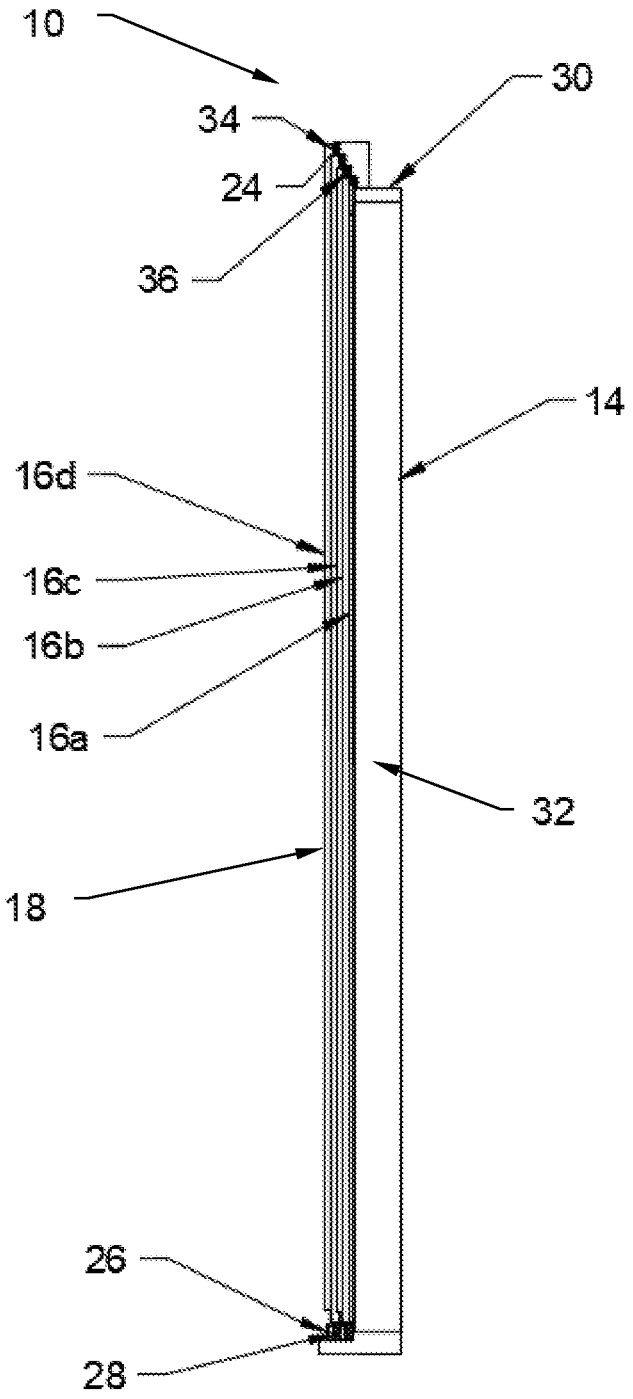
FIG. 4 is a side elevation view of the panel door system in the open position shown in FIG. 1.

Referring to FIG. 3 and FIG. 4, a bottom guide groove 26 is positioned at a bottom of entrance 22 such that a bottom end 28 of panels 16*a*, 16*b*, 16*c* and 16*d* are positioned within bottom guide groove 26. Bottom guide groove 26 provides guidance to panels 16*a*, 16*b*, 16*c* and 16*d* and prevents excessive swinging of panels 16*a*, 16*b*, 16*c* and 16*d* during movement. Bottom guide groove 26 may also prevent binding of panels 16*a*, 16*b*, 16*c* and 16*d* as they move.

Support tracks 12*a*, 12*b*, 12*c* and 12*d* may be made of any suitable material known in the art. The use of a substantially rigid material such as extruded aluminum sections is preferable. Support tracks 12*a*, 12*b*, 12*c* and 12*d* may be configured from one or more pieces of material to aid in manufacturability, assembly or cost. Mounting hardware may include standard fasteners and brackets that connect support tracks 12*a*, 12*b*, 12*c* and 12*d* rigidly to header 30 or support columns 32. Panels 16*a*, 16*b*, 16*c* and 16*d* may be made of any suitable material known in the art. However, the use of extruded aluminum may be beneficial due to its relatively high strength to weight ratio. Panel door system 10 may be used in any suitable application and may be suitable for use in elevators and moving carriage elevator systems where the compact space requirements of panel door system 10 could be useful.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. A panel door system comprising:

at least two distinct support tracks mounted to a support structure such that each support track is offset from a previous support track both horizontally and vertically, and each of the at least two support tracks having a first end and a second end;

a panel hanging from each of the at least two distinct support tracks by a hanging mechanism such that each panel is hanged on a different support track, the panels creating a door, the panels respectively being movable along the at least two distinct support tracks in a first direction to open the door and in a second direction to close the door, the panels being offset from each other when the door is closed, the panels being stacked horizontally within a door receiving space when the door is in the open position, and the door receiving space being discrete from and adjacent to an entrance created when the panels are moved in the first direction to the first end of the at least two distinct support tracks.

2. The panel door system of claim 1 wherein each of the at least two distinct support tracks is mounted such that each adjacent track is positioned anterior to and above the previous track with the first track being the lowest and most posterior track.

3. The panel door system of claim 1 wherein the horizontal offset and the vertical offset are equal.

4. The panel door system of claim 1 wherein the hanging mechanism is at least one roller.

5. The panel door system of claim 1 wherein a bottom end of the at least two panels is positioned within a bottom guide groove.

6. The panel door system of claim 1 wherein the support structure is a header.

7. The panel door system of claim 1 wherein the support structure supports the first end and the second end of each of the at least two distinct support tracks.

8. The panel door system of claim 1 wherein the panels are made of extruded aluminum.

* * * * *